US009657726B1

(12) United States Patent
Bonny

(10) Patent No.: US 9,657,726 B1
(45) Date of Patent: May 23, 2017

(54) HYDRAULIC RUNNING SURFACE

(71) Applicant: Hydro-Gear Limited Partnership, Sullivan, IL (US)

(72) Inventor: Nathan W. Bonny, Shelbyville, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 305 days.

(21) Appl. No.: 14/248,570

(22) Filed: Apr. 9, 2014

Related U.S. Application Data

(60) Provisional application No. 61/813,972, filed on Apr. 19, 2013.

(51) Int. Cl.
*F04B 1/20* (2006.01)
*F04B 27/08* (2006.01)

(52) U.S. Cl.
CPC ..... *F04B 1/2021* (2013.01); *F04B 27/0804* (2013.01); *F04B 27/0826* (2013.01)

(58) Field of Classification Search
CPC .... F04B 39/1066; F04B 53/10; F04B 53/007; F04B 1/2042; F04B 1/2021; F16H 39/14; F16H 61/4139; F16H 61/0009; F03C 1/0636
USPC ..... 417/312, 299, 269; 99/499, 6.5
See application file for complete search history.

(56) References Cited

U.S. PATENT DOCUMENTS 2,633,104 A 3/1953 Lauck et al.
3,585,901 A 6/1971 Moon et al.
3,625,253 A 12/1971 Christiansen
4,034,652 A 7/1977 Huebner
4,920,856 A 5/1990 Berthold et al.
(Continued)

FOREIGN PATENT DOCUMENTS

JP 10077955 A * 3/1998 ..... F04B 1/22
JP 10131843 A * 5/1998 ..... F04B 1/22
(Continued)

OTHER PUBLICATIONS

Bonny, N.W., U.S. Appl. No. 13/480,134, filed May 24, 2012, pp. 1-34.
(Continued)

*Primary Examiner* — Charles Freay
*Assistant Examiner* — Thomas Cash
(74) *Attorney, Agent, or Firm* — Neal, Gerber & Eisenberg LLP

(57) ABSTRACT

A mounting member for a hydraulic pump or other rotating kit for a hydraulic drive device includes a running surface having a pair of arcuate kidney ports formed thereon. The running surface also includes a plurality of pressure gradient grooves formed on the running surface, each pressure gradient groove having a proximal end adjacent to a respective one of the ends of one of the kidney ports and a distal end. The distal end of one of the pressure gradient grooves associated with one kidney port may overlap the distal end of a pressure gradient groove associated with the other kidney port. The distal end of at least one of the pressure gradient grooves is located outside the circumference of a pitch circle that passes through the center of each of the kidney ports. The distal end of at least one of the other pressure gradient grooves is located inside the circumference of the pitch circle.

20 Claims, 10 Drawing Sheets

(56) References Cited

U.S. PATENT DOCUMENTS

| | | | |
|---|---|---|---|
| 5,033,358 | A | 7/1991 | Molly |
| 5,094,146 | A | 3/1992 | Molly |
| 5,230,274 | A | 7/1993 | Yu et al. |
| 6,332,393 | B1 | 12/2001 | Trimble |
| 6,510,779 | B2 | 1/2003 | Greene et al. |
| 6,880,448 | B1 | 4/2005 | Langenfeld |
| 7,905,711 | B2 | 3/2011 | Mochizuki et al. |
| 2013/0055888 | A1 | 3/2013 | Ohno et al. |

FOREIGN PATENT DOCUMENTS

| | | | | |
|---|---|---|---|---|
| JP | 2010131843 | | 5/1998 | |
| JP | 2001221317 | | 8/2001 | |
| JP | 2001221317 A | * | 8/2001 | ..... F16H 39/10 |

OTHER PUBLICATIONS

Templin, A.J., U.S. Appl. No. 14/215,999, filed Mar. 17, 2014, pp. 1-25.

* cited by examiner

HYDRAULIC RUNNING SURFACE

CROSS-REFERENCE TO RELATED APPLICATION

This application claims the benefit of U.S. Provisional Patent Application No. 61/813,972, filed on Apr. 19, 2013, the contents of which are fully incorporated herein by reference.

BACKGROUND OF THE INVENTION

This invention relates generally to a running surface on which a hydraulic rotating kit such as a hydraulic pump cylinder block is rotatably mounted.

SUMMARY OF THE INVENTION

An improved running surface having pressure gradient grooves adjacent to the respective kidney ports is disclosed herein. In one aspect of this disclosure, at least one of the pressure gradient grooves has a distal end located outside of the pitch circle formed by the kidney ports and at least one of the pressure gradient grooves has a distal end located inside the circumference of the pitch circle. In another aspect of this disclosure, the distal ends of opposing pressure gradient grooves overlap each other. In the embodiments depicted herein, the two pressure gradient grooves with their distal ends disposed outside this circumference correspond to the trailing end of the respective kidney ports, while the other two pressure gradient grooves correspond to the leading end of their respective kidney ports. This design results in improved pressure and flow pulsations in the unit and reduced noise. The disclosure herein may be used in connection with pump end caps, center sections and other mounting structure for one or more rotating kits used in a hydraulic drive device or other application, and may be used with or without a separate valve plate.

A better understanding of the objects, advantages, features, properties and relationships of the invention will be obtained from the following detailed description and accompanying drawings which set forth illustrative embodiments that are indicative of the various ways in which the principles of the invention may be employed.

DETAILED DESCRIPTION OF THE DRAWINGS

Figure 1:
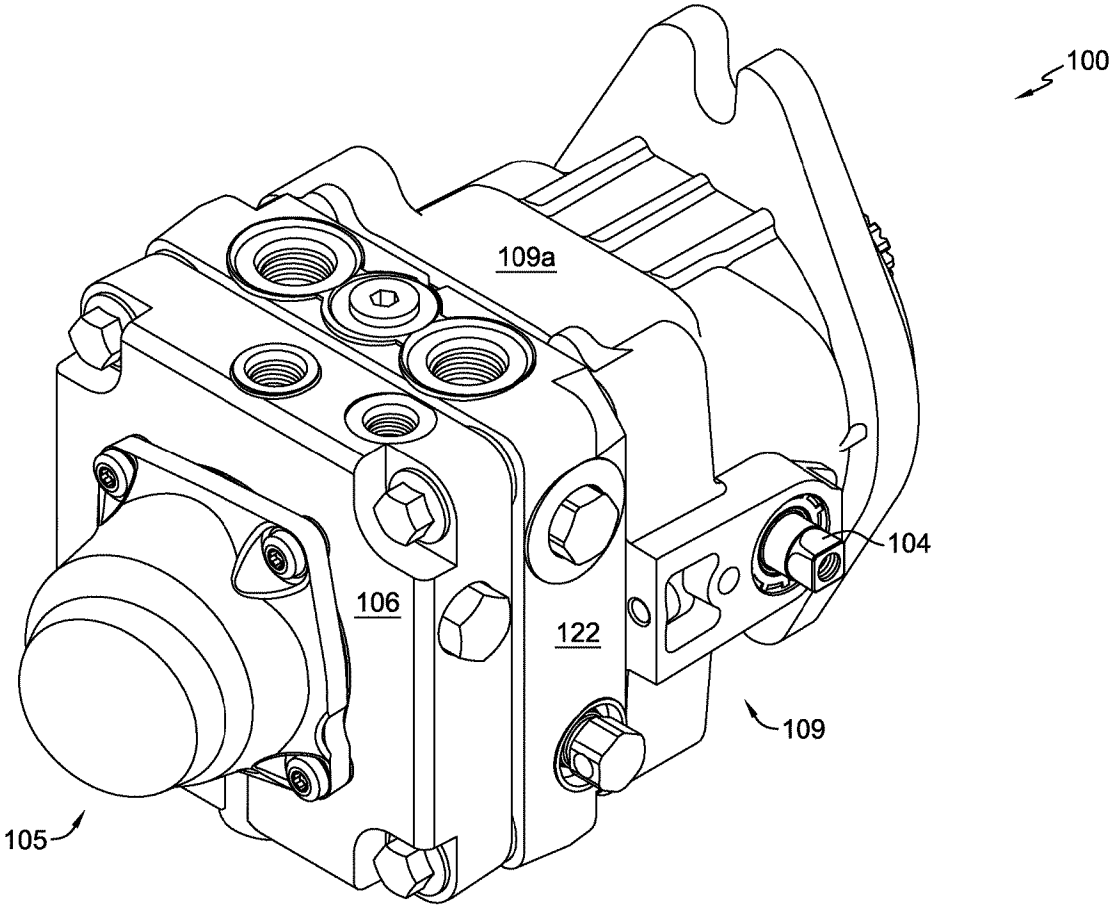
FIG. 1 is a perspective view of an exemplary pump assembly using an end cap incorporating teachings of the present invention.

The description that follows describes, illustrates and exemplifies one or more embodiments of the invention in accordance with its principles. This description is not provided to limit the invention to the embodiment(s) described herein, but rather to explain and teach the principles of the invention in order to enable one of ordinary skill in the art to understand these principles and, with that understanding, be able to apply them to practice not only the embodiment(s) described herein, but also any other embodiment that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers or serial numbers in cases where such labeling facilitates a more clear description. Additionally, the drawings set forth herein are not necessarily drawn to scale, and in some instances proportions may have been exaggerated to more clearly depict certain features. As stated above, this specification is intended to be taken as a whole and interpreted in accordance with the principles of the invention as taught herein and understood by one of ordinary skill in the art.

Figure 9:
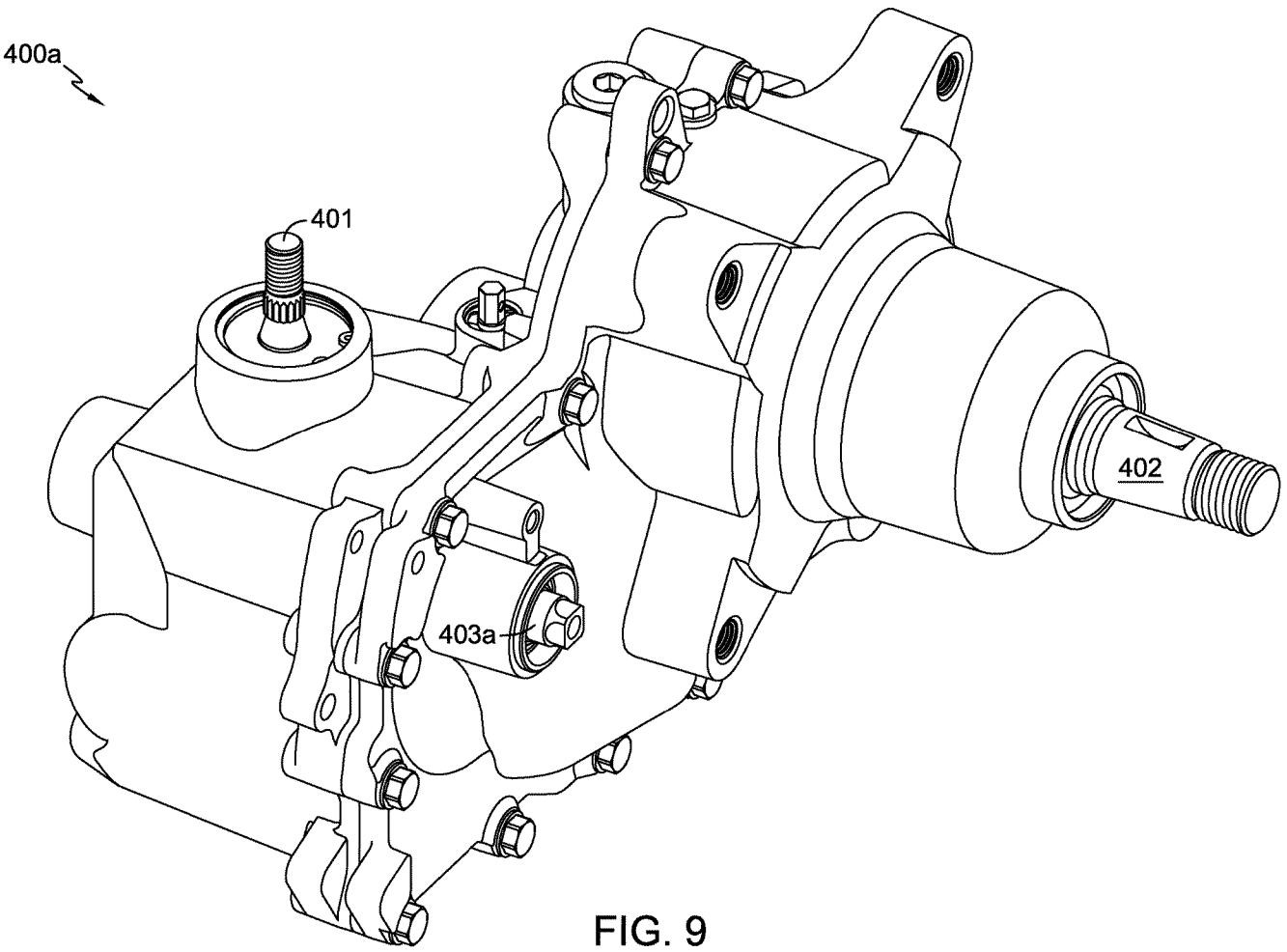
FIG. 9 is a perspective, external view of an exemplary transaxle which may incorporate a running surface in accordance with one or more teachings disclosed herein.
Figure 10:
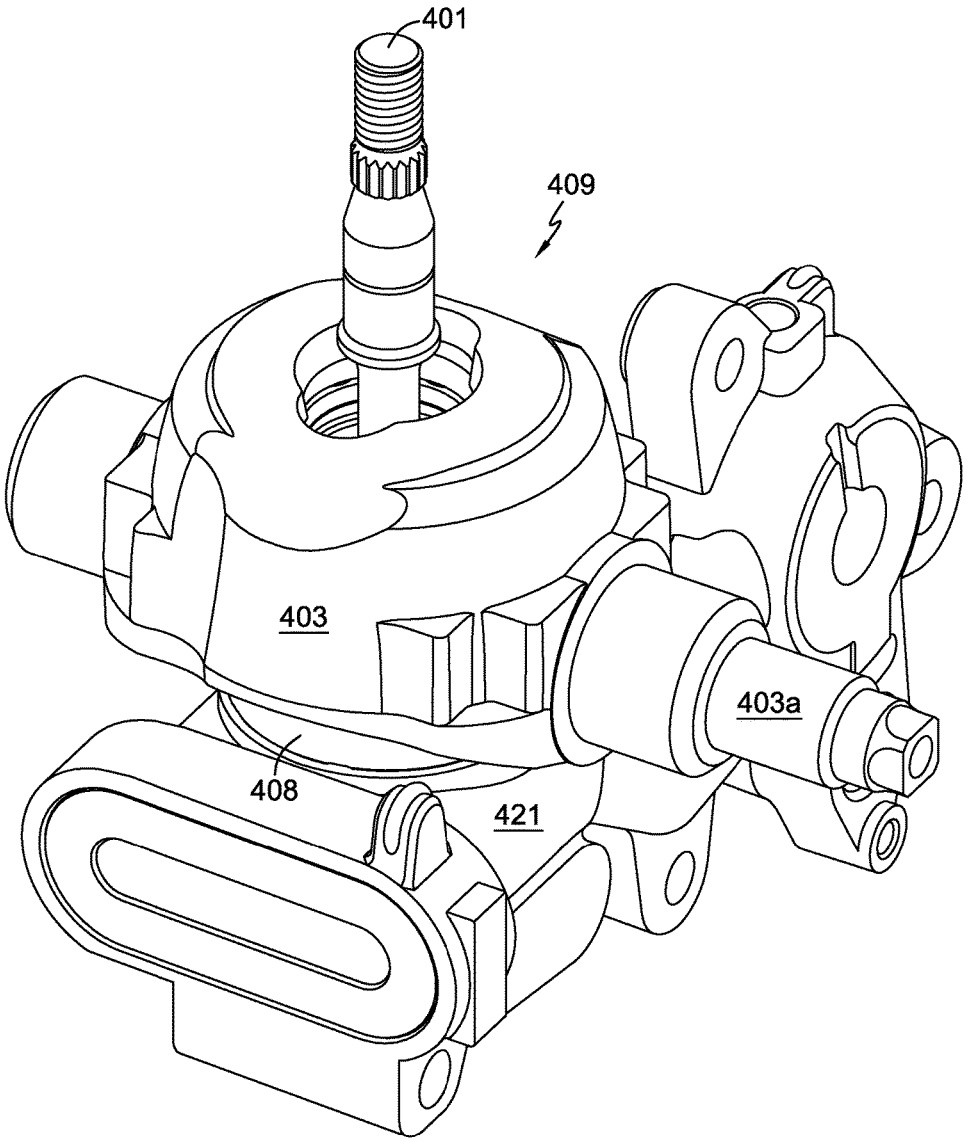
FIG. 10 is a perspective view of certain components of an exemplary hydraulic drive assembly which may be used in the transaxle of FIG. 9.
Figure 11:
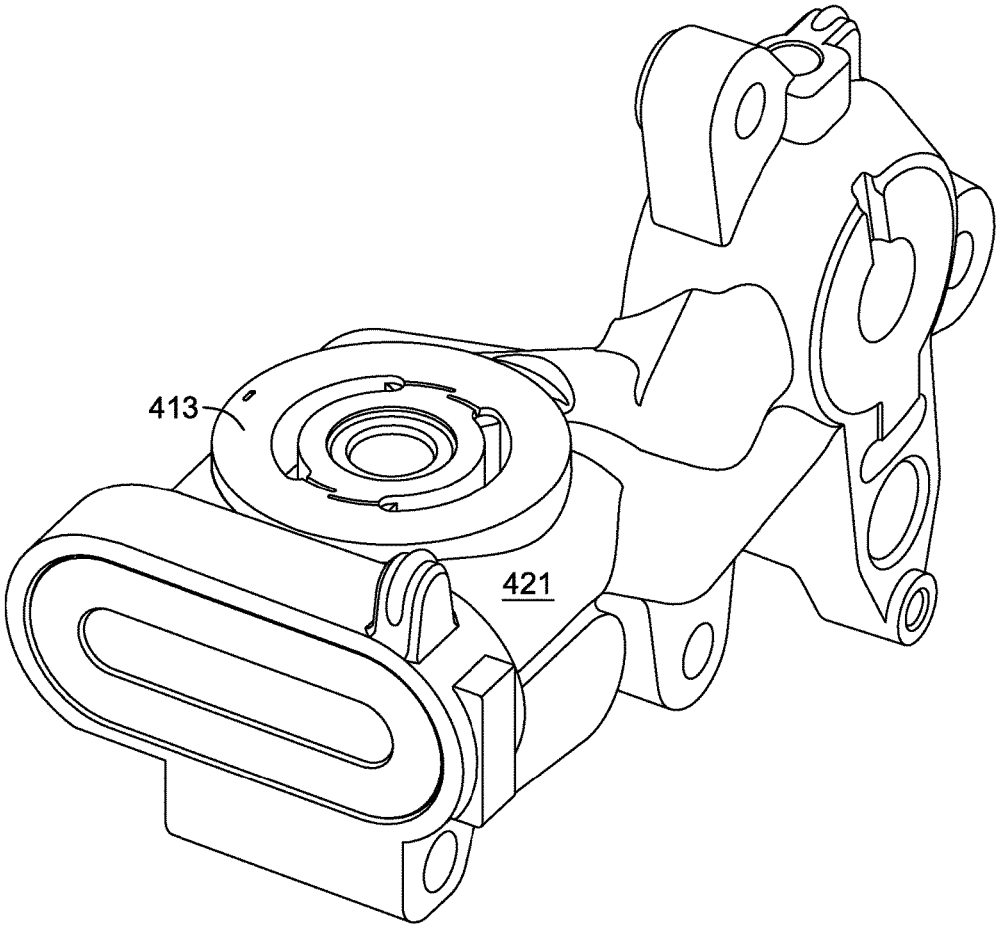
FIG. 11 is a perspective view of the center section depicted in FIG. 10, showing the running surface thereof.
Figure 12:
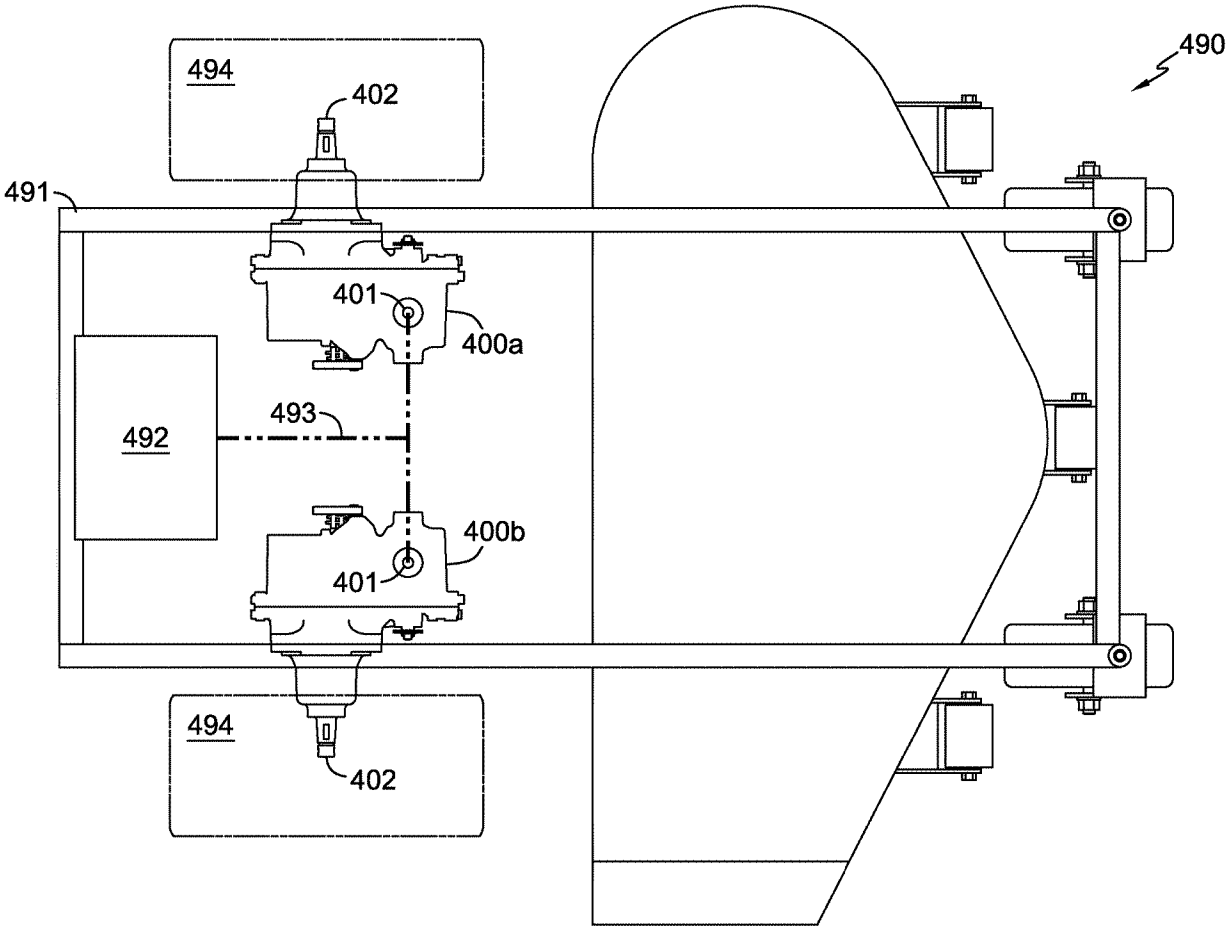
FIG. 12 is a plan view of an exemplary vehicle incorporating the transaxle of FIG. 9.

An exemplary pump assembly 100 is shown in FIG. 1, where a main pump 109 includes an end cap 122 disposed between main pump housing 109*a* and a separate end cap 106 for an auxiliary pump 105. A trunnion arm 104 extends out of housing 109*a* and is used to control the displacement of the hydraulic pump (not shown) located in main pump housing 109*a*. A transaxle that can also use the teachings of this invention is depicted in FIGS. 9-11, which disclose a hydraulic pump 409 including a pump shaft 401 driving a cylinder block 408, which is disposed on a running surface 413 located on center section 421. A swash plate 403 is controlled by trunnion arm 403*a*. FIG. 12 depicts an exemplary vehicle 490 having transaxles 400*a*, 400*b* mounted on a frame 491, where output axles 402 drive a pair of wheels 494 for zero turn operation. Transaxles 400*a*, 400*b* are driven by prime mover 492 through a belt and pulley assembly 493. The pump assembly 100 and end caps 122 are similar in many respects to those disclosed in commonly owned U.S. Pat. No. 9,074,670 and commonly owned U.S. Pat. No. 6,332,393, and the transaxle 400*a* is similar in many respects to that disclosed in commonly owned U.S. Pat. No. 9,341,258. The disclosures of these patents, which are incorporated by reference herein in their entirety, also teach other elements of hydraulic pump assemblies and transaxles that may be relevant to this disclosure.

Turning first to the embodiment shown in FIGS. 2-5, end cap 122 has a running surface 113 with a pair of arcuate kidney ports 118 and 119 formed thereon to communicate with hydraulic porting 120 internal thereto, which is understood to constitute various internal passages. In general, kidney ports 118 and 119 are symmetrically disposed about the centerline 112 of running surface 113, as indicated by the reflective angles 'B' which are preferably in the range of 22 to 24 degrees. A rotating pump cylinder block, such as cylinder block 408, may be disposed on running surface 113, and a pump or input shaft, such as input shaft 401, would extend through the pump and shaft support bore 111 formed in end cap 122. As is known in the art, system ports 126 and 127 may be formed in one side of end cap 122 to permit the pump and hydraulic porting 120 to communicate with other parts of a hydraulic system such as, for example, a hydraulic motor (not shown). A diagnostic port 128 is also depicted between system ports 126 and 127, and end cap 122 may optionally include stiffening ribs 117 to ensure flatness of running surface 113 under load. It will be understood that end cap 122 includes other ports such as a bypass port, inlet port, etc., none of which are specifically shown but which may be formed on other sides of end cap 122.

Figure 2:
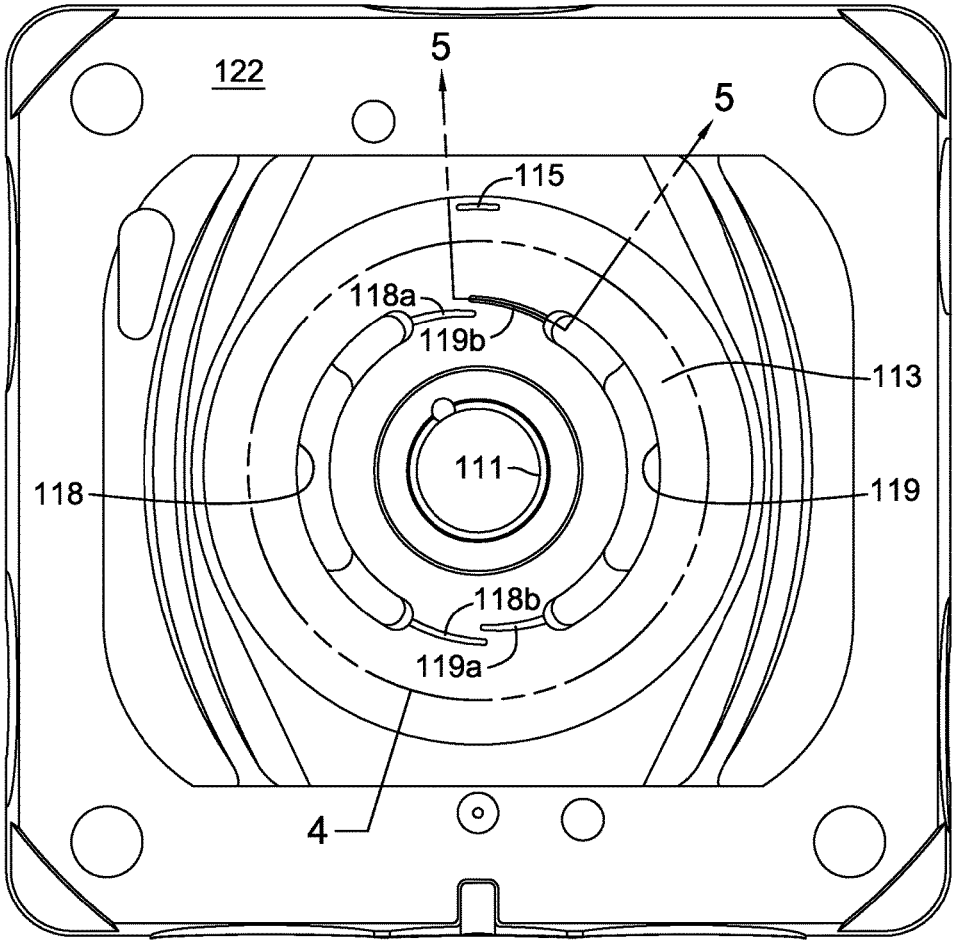
FIG. 2 is a plan view of an end cap for a hydraulic drive unit such as the pump assembly shown in FIG. 1 and having a running surface in accordance with one or more of the principles disclosed herein.
Figure 3:
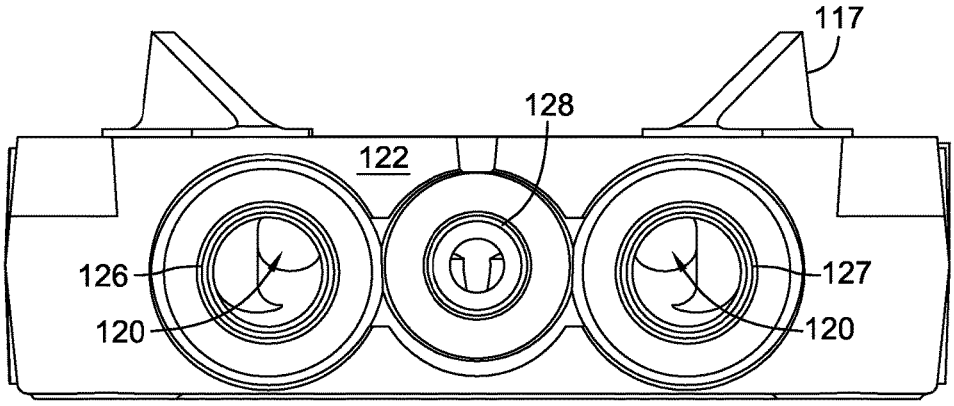
FIG. 3 is a side elevational view of the end cap of FIG. 2.
Figure 4:
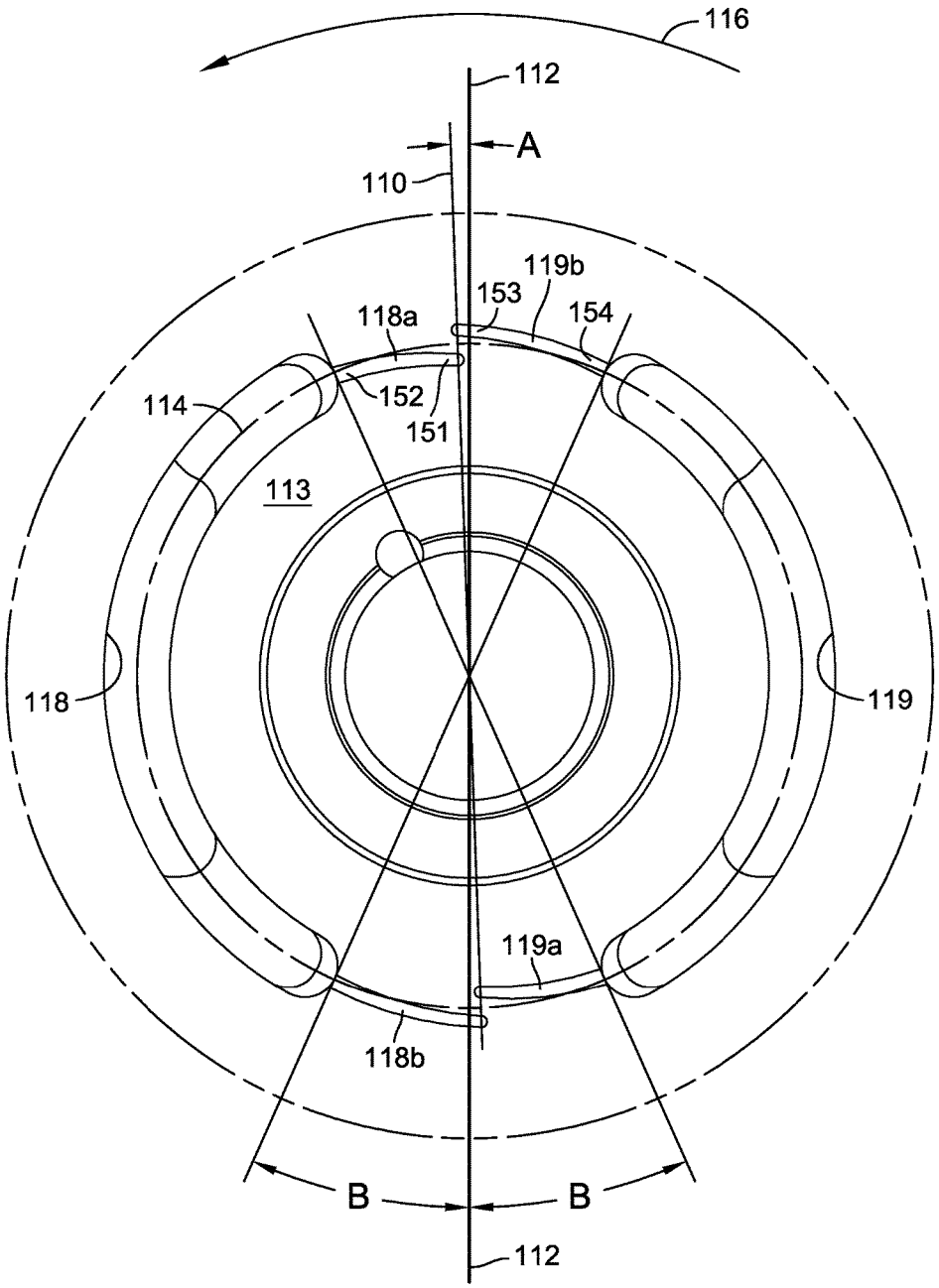
FIG. 4 is a plan view of a portion of the running surface of the end cap shown in FIG. 2.

The terms "rat tail" or "fishtail" are often used to describe a pressure gradient groove formed on a running surface adjacent the end of a kidney port, such as the pressure gradient grooves 118*a*, 118*b*, 119*a* and 119*b* shown in FIG. 2. In this application, the terms "pressure gradient groove" or "groove" will generally be used to describe these features. The term "pitch circle" is used to describe the circle 114 that runs generally through the center of each of the kidney ports 118, 119 and aligns with the rotational path the pump cylinders in the cylinder block (not shown) traverse. This term is not used in the mathematical sense but should be understood to incorporate ordinary engineering and machining tolerances. The term "kidney port" is also used broadly to describe the ports on a running surface for a rotating cylinder block to permit fluid communication between the cylinder block and a hydraulic porting system.

Each kidney port 118 and 119 has two opposing ends, and a groove formed at each end. Grooves 118*a* and 118*b* extend from opposing ends of kidney port 118 while grooves 119*a* and 119*b* extend from opposing ends of kidney port 119. As can be seen most clearly in FIG. 4, groove 119*b* has a proximal end 154 adjacent one end of kidney port 119 and distal end 153 which is disposed outside the circumference of pitch circle 114. Groove 118*a* has a proximal end 152 adjacent one end of kidney port 118 and distal end 151 which is disposed inside the circumference of pitch circle 114. It can be further seen that while distal end 151 approaches centerline 112, distal end 153 passes over the centerline 112 such that the radial centers of distal ends 151 and 153 lie on a line 110 that is radially offset from centerline 112, forming an angle 'A' therewith, which is preferably 2 degrees. This arrangement permits an overlap between the distal ends 151 and 153 of grooves 118*a* and 119*b*, to permit communication between these two grooves during operation. The same arrangement is preferably used with grooves 119*a* and 118*b* formed at the other ends of respective kidney ports 119 and 118. Such overlap and the resulting communication between the two pressure sides improves the ability of the unit to find and maintain neutral under no load conditions. It will be understood, however, that the relationship of the various distal ends of the grooves with respect to one another may be varied within the principles and scope of this disclosure. For example, the overlap of distal ends 151 and 153 could be greater than that depicted in FIG. 4, such that the radial centers of these distal ends are no longer on line 110. In the embodiment shown, the rotation of the pump cylinder block is counterclockwise, as depicted by reference arrow 116, so that grooves 118*b* and 119*b* are the trailing grooves, while grooves 118*a* and 119*a*, inside the circumference of the pitch circle, are leading. It will be understood that the design could be mirrored for clockwise rotation if preferred.

Figure 5:
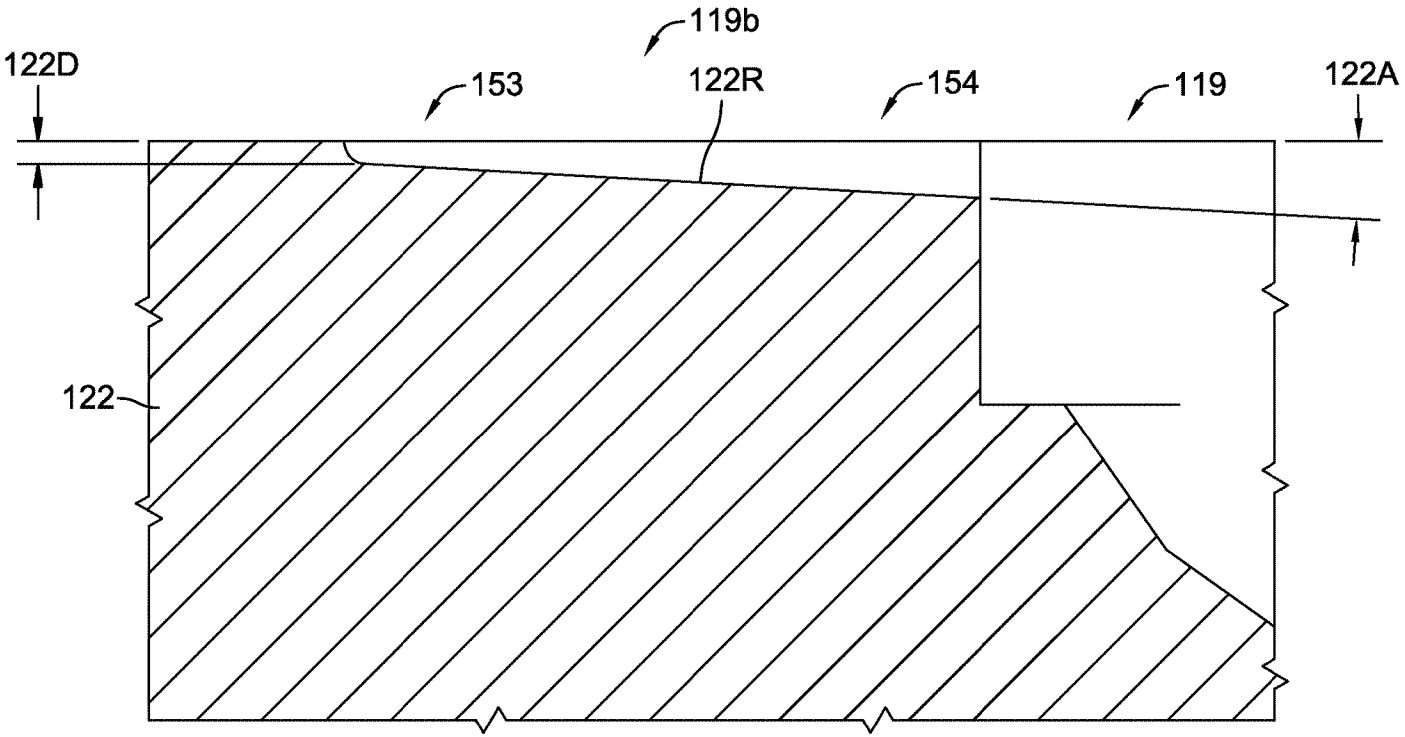
FIG. 5 is a cross-sectional view along the line 5-5 of FIG. 2.

The depth of each groove 118*a* and 119*b* varies from one end to the other, being deeper at the proximal end 152, 154 adjacent the end of the respective kidney port and shallower at the distal end 151, 153. It will be understood that the other grooves 118*b* and 119*a* would be identical to their corresponding groove. These grooves have a generally flat ramp 122R as shown in the cross-sectional view of groove 119*b* in FIG. 5. Ramp 122R extends at a constant ramp angle 122A from the initial depth 122D, preferably 0.016 in. for each groove. In grooves 119*b* and 118*b*, ramp angle is preferably 3 degrees, while in grooves 118*a* and 119*a* the preferred ramp angle is 7 degrees. The terminus of groove 119*b* adjacent proximal end 154 is depicted in FIG. 5 as a vertical drop into kidney port 119, but it will be understood that this portion (and the equivalent portion of the other grooves) could also be radiused if desired.

FIG. 2 also depicts a separate reference groove 115 that is not functional during operation of the apparatus but is used to ensure that the existing grooves are machined to the proper depth and profile. This optional reference groove is machined as a flat or constant depth groove, rather than a ramped groove, using the same tool that forms grooves 118*a*, 118*b*, 119*a*, and 119*b*, and is preferably machined to a depth of 0.016 in. This eliminates the need to artificially flatten a portion of the ramped grooves to create a specific location for gauging tool performance. Eliminating this flattened portion of the ramped grooves further reduces flow and pressure pulsations as cylinder pistons transition between kidney ports 118 and 119. It should be understood that the specific location of reference groove 115 may be varied.

Figure 8:
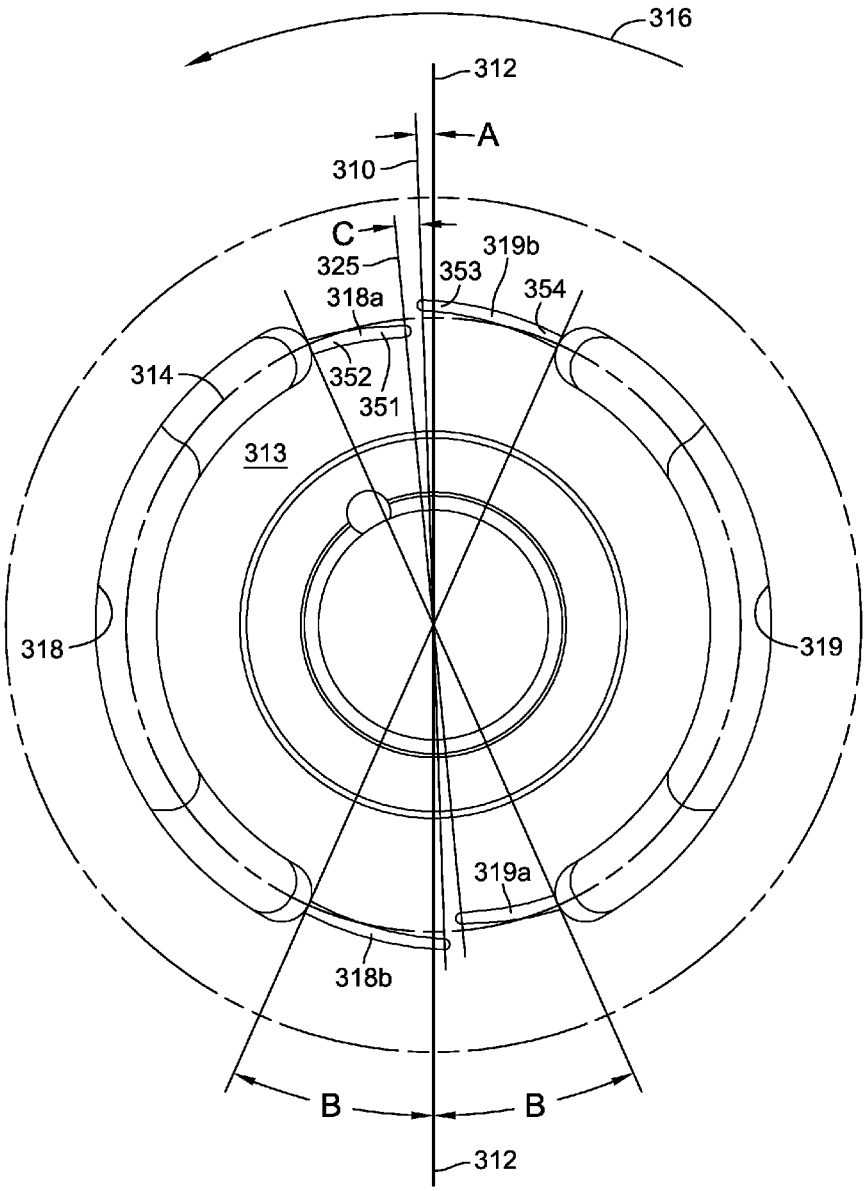
FIG. 8 is a plan view of a portion of a running surface for a second embodiment of the invention.

A further embodiment is depicted in FIG. 8, depicting running surface 313 where grooves 318*a*, 318*b*, 319*a* and 319*b* are similar in many respects to those previously disclosed. As shown by reference arrow 316, this embodiment is intended for counterclockwise rotation of the cylinder block. The distal ends 351 and 353 of the respective grooves are offset from pitch circle 314, but do not overlap. Specifically, groove 318*a* has a proximal end 352 adjacent one end of kidney port 318 and distal end 351 which is disposed inside the circumference of pitch circle 314. Distal end 353 passes over the centerline 312 such that the radial center of distal end 353 lies on a line 310 with the radial center of the corresponding trailing groove 318*b*. Line 310 is radially offset from centerline 312, forming an angle 'A' therewith, which is preferably 2 degrees. The radial center of distal end 351 of groove 318*a* is further offset from centerline 312, and lies on a line 325 with the radial center of the distal end of corresponding leading groove 319*a*, with line 325 forming an angle 'C' with line 310, with the angle 'C' being preferably from one to three degrees. It will be understood that the values of the angles 'A,' 'B,' and 'C' can be varied depending on the size of the rotating kits being used and the desired performance characteristics. For example, a larger value for the 'C' angle corresponds to a more aggressive response, but correspondingly increased noise. It has also been determined that the overlap design shown in, e.g., FIG. 2 provides a smoother response to user inputs to the transmission, whereas the "gap" design of FIG. 8 provides a more aggressive response to such inputs.

Figure 7:
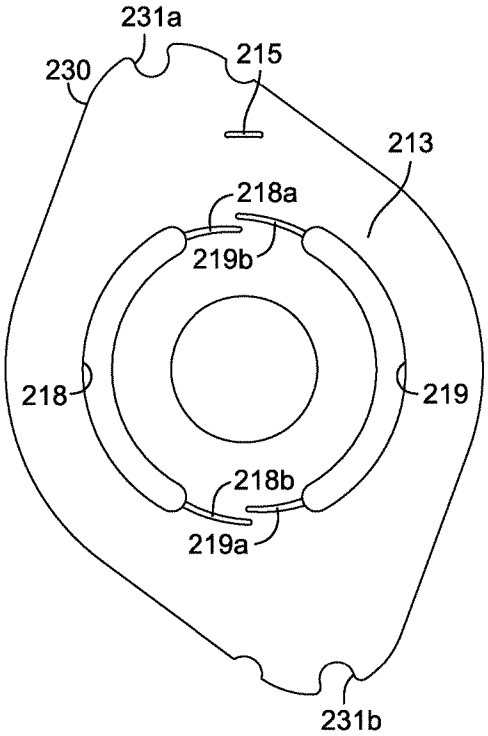
FIG. 7 is a plan view of the valve plate to be applied to the end cap of FIG. 6.
Figure 6:
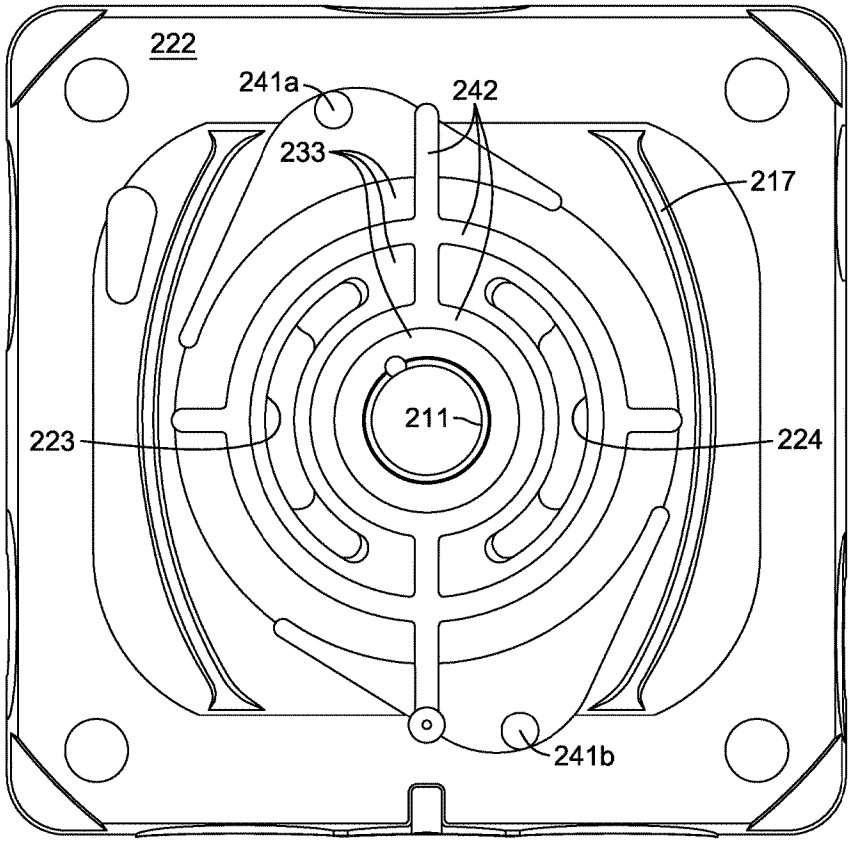
FIG. 6 is a plan view of a second end cap for a hydraulic drive unit, adapted to receive a valve plate formed in accordance with one or more of the principles disclosed herein.

While FIGS. 1-4 depict a running surface 113 that is integrally formed on a pump end cap 122, it can be seen from FIGS. 9-11 that a similar running surface 413 could be formed on center section 421 on which both pump cylinder block 408 and a motor cylinder block (not shown) are disposed. Other similar structure for rotatably mounting a cylinder block could be used. In addition, a valve plate attached or disposed on an end cap, center section or other structure could also be used with the pressure gradient grooves depicted in FIG. 4 or 8 formed thereon. Such an embodiment is depicted in FIGS. 6 and 7, where valve plate 230 is mounted on a mounting surface 233 of end cap 222. Valve plate 230 provides a running surface 213 separate from end cap 222, along with a first pair of kidney ports 218 and 219 extending through valve plate 230 and communicating with a second pair of kidney ports 223 and 224 in end cap 222. Pressure gradient grooves 218*a* and 218*b* are provided for kidney port 218, while pressure gradient grooves 219*a* and 219*b* are provided for kidney port 219 in a manner similar to that described for the first embodiment. Reference groove 215 may also be machined in valve plate 230 in the same manner as, and for the same purpose as reference groove 115 in the first embodiment. Shaft support bore 211 is also provided in end cap 222 for the pump or input shaft, such as input shaft 401 or its equivalent. Stiffening ribs 217 may optionally be provided in this embodiment also. Valve plate 230 may be located on end cap 222 using pins 241*a* and 241*b* engaged to corresponding notches 231*a* and 231*b*. A plurality of pressure relief passages 242 may be formed on end cap 222 under valve plate 230 to help eliminate any tendency of valve plate 230 to lift off the surface of end cap 222 during operation.

While specific embodiments have been described in detail, it will be appreciated by those skilled in the art that various modifications and alternatives to those presented herein could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. A running surface for connecting a rotatable pump cylinder block to a hydraulic circuit, the running surface comprising:

a first kidney port having a first leading end and a first trailing end, and a second kidney port having a second leading end and a second trailing end, the first and second kidney ports each having a generally arcuate shape and a center, and defining a pitch circle passing generally through the center of the first kidney port and the center of the second kidney port;

a first pressure gradient groove connected to the first kidney port and having a first proximal end connected to the first leading end, and a first distal end;

a second pressure gradient groove connected to the first kidney port and having a second proximal end connected to the first trailing end, and a second distal end;

a third pressure gradient groove connected to the second kidney port and having a third proximal end connected to the second leading end, and a third distal end;

a fourth pressure gradient groove connected to the second kidney port and having a fourth proximal end connected to the second trailing end, and a fourth distal end;

wherein the second distal end and the fourth distal end are disposed outside the pitch circle and the first distal end and the third distal end are disposed inside the pitch circle.

2. The running surface of claim 1, wherein the fourth distal end overlaps the first distal end along a first arc of the pitch circle.

3. The running surface of claim 2, wherein the second distal end overlaps the third distal end along a second arc of the pitch circle.

4. The running surface of claim 3, wherein each of the distal ends of each of the pressure gradient grooves has a radial center that lies on the same line offset from a centerline extending through the center of the pitch circle, wherein the first kidney port is located on one side of the centerline and the second kidney port is located on the other side of the centerline.

5. A mounting member for a rotating kit for a hydraulic drive device, the rotating kit having a leading edge and a trailing edge, the mounting member comprising:

a running surface having a pair of kidney ports formed thereon, each kidney port having a generally arcuate shape, a first end and a second end, wherein a circle passing through each generally arcuate kidney port defines a pitch circle having a defined circumference;

a plurality of pressure gradient grooves formed on the running surface, each pressure gradient groove having a proximal end connected to a respective one of the ends of one of the pair of kidney ports and a distal end, wherein the distal end of at least one of the pressure gradient grooves is located outside the circumference of the pitch circle and the distal end of at least another of the pressure gradient grooves is located inside the circumference of the pitch circle.

6. The mounting member of claim 5, wherein the distal ends of at least two of the pressure gradient grooves are located outside the circumference of the pitch circle.

7. The mounting member of claim 6, wherein the proximal ends of all of the pressure gradient grooves are disposed on the pitch circle.

8. The mounting member of claim 5, wherein the distal ends of two of the pressure gradient grooves are located outside the circumference of the pitch circle and the distal ends of the other two pressure gradient grooves are located inside the circumference of the pitch circle.

9. The mounting member of claim 8, wherein the distal ends of the pressure gradient grooves that are disposed outside the circumference of the pitch circle correspond to the trailing edge of the rotating kit and the distal ends of the pressure gradient grooves that are disposed inside the circumference of the pitch circle correspond to the leading edge of the rotating kit.

10. The mounting member of claim 5, wherein the distal ends of at least two of the pressure gradient grooves are located inside the circumference of the pitch circle.

11. The mounting member of claim 5, wherein the running surface is integrally formed on the mounting member.

12. The mounting member of claim 11, further comprising a reference groove formed on the running surface outside the circumference of the pitch circle.

13. The mounting member of claim 5, further comprising a mounting surface, and a valve plate disposed on the mounting surface, wherein the running surface is formed on the valve plate.

14. The mounting member of claim 13, further comprising a reference groove formed on the running surface outside the circumference of the pitch circle.

15. The mounting member of claim 13, further comprising a plurality of pressure relief passages formed on the mounting surface and disposed at least partially under the valve plate.

16. A drive device, comprising:

a rotating pump cylinder block disposed on a mounting member in a housing; and a running surface located on the mounting member, the running surface comprising:

a first kidney port formed on one side of a centerline and having a generally arcuate shape;

a second kidney port formed on an opposite side of the centerline and being symmetric with the first kidney port, wherein a circle passing through the first kidney port and the second kidney port defines a pitch circle having a defined circumference;

a first pair of pressure gradient grooves formed on the running surface and connected to the first kidney port, each one of the first pair of pressure gradient grooves having a first proximal end and a first distal end, wherein each first proximal end is connected to a respective opposite end of the first kidney port; and a second pair of pressure gradient grooves formed on the running surface and connected to the second kidney port, each one of the second pair of pressure gradient grooves having a second proximal end and a second distal end, wherein each second proximal end is connected to a respective opposite end of the second kidney port, wherein the first distal end of one of the first pair of pressure gradient groove overlaps the second distal end of one of the second pair of pressure gradient grooves along a first arc of the pitch circle.

17. The drive device of claim 16, wherein the first distal end of the other of the first pair of pressure gradient groove overlaps the second distal end of the other of the second pair of pressure gradient grooves along a second arc of the pitch circle.

18. The drive device of claim 16, wherein each distal end of each pressure gradient groove has a radial center, and the radial center of each of the distal ends of each of the pressure gradient grooves lies on a common line offset from the centerline.

19. The drive device of claim 16, further comprising a mounting surface formed on the mounting member, and a valve plate disposed on the mounting surface, wherein the running surface is formed on the valve plate.

20. The drive device of claim 16, wherein the mounting member comprises a center section disposed in the housing.

* * * * *